US008979312B2

(12) United States Patent
Chen et al.

(10) Patent No.: US 8,979,312 B2
(45) Date of Patent: Mar. 17, 2015

(54) LIGHT EMITTING DIODE BULB

(71) Applicant: Advanced Optoelectronic Technology, Inc., Hsinchu Hsien (TW)

(72) Inventors: Lung-Hsin Chen, Hsinchu (TW); Wen-Liang Tseng, Hsinchu (TW)

(73) Assignee: Advanced Optoelectronic Technology, Inc., Hsinchu Hsien (TW)

( * ) Notice: Subject to any disclaimer, the term of this patent is extended or adjusted under 35 U.S.C. 154(b) by 0 days.

(21) Appl. No.: 14/014,366

(22) Filed: Aug. 30, 2013

(65) Prior Publication Data

US 2014/0119008 A1 May 1, 2014

(30) Foreign Application Priority Data

Oct. 31, 2012 (CN) ..... 2012 1 0426497

(51) Int. Cl.

| | |
|---|---|
| ***F21V 5/00*** | (2006.01) |
| ***F21K 99/00*** | (2010.01) |
| ***F21V 5/04*** | (2006.01) |
| *F21Y 111/00* | (2006.01) |

(52) U.S. Cl.

CPC ..... *F21K 9/135* (2013.01); *F21V 5/048* (2013.01); *F21K 9/10* (2013.01); *F21Y 2111/007* (2013.01)

USPC ..... 362/255; 362/311.06; 362/311.09; 362/311.1

(58) Field of Classification Search

CPC ..... F21K 9/10; F21K 9/13; F21K 9/135; F21K 9/1355; F21K 9/30; F21K 9/50; F21K 99/00; F21S 48/1233; F21V 5/04; F21V 5/046; F21V 5/048; F21V 17/00; F21V 17/06

USPC ..... 362/249.02, 255, 256, 333, 334, 335, 362/240, 244, 311.01, 311.02, 311.06, 362/311.09, 311.1, 311.13, 311.14, 311.15

See application file for complete search history.

(56) References Cited

U.S. PATENT DOCUMENTS

| | | | | |
|---|---|---|---|---|
| 8,496,349 | B2 * | 7/2013 | Wu et al. | 362/249.02 |
| 2011/0194288 | A1 * | 8/2011 | Hsu | 362/311.01 |
| 2012/0044692 | A1 * | 2/2012 | Liang et al. | 362/257 |
| 2012/0188767 | A1 * | 7/2012 | Igaki et al. | 362/249.02 |
| 2012/0287636 | A1 * | 11/2012 | Chen | 362/249.02 |
| 2013/0062631 | A1 * | 3/2013 | Liu | 257/88 |
| 2013/0148328 | A1 * | 6/2013 | Park et al. | 362/84 |

FOREIGN PATENT DOCUMENTS

| | | | |
|---|---|---|---|
| JP | 3164404 | U | 11/2010 |
| JP | 2012185949 | A | 9/2012 |
| WO | 2010053147 | A1 | 5/2010 |

* cited by examiner

*Primary Examiner* — Y M Lee

(74) *Attorney, Agent, or Firm* — Novak Druce Connolly Bove + Quigg LLP

(57) ABSTRACT

A light emitting diode (LED) bulb includes a connecting body, a mounting base located on the connecting body and a plurality of LED modules mounted on the mounting base. The mounting base has a top face spaced from the connecting body and at least three surrounding walls. The top face of the mounting base orients toward a direction different that of each of the at least three surrounding walls. A lamp cover is secured to the connecting body and encloses the LED modules. An extension of the top face of the mounting base interests with the lamp cover at a point. A tangent line of the lamp cover through the point and the extension of the top face form an included angle which is less than 60 degrees. Furthermore, a center of the lamp cover is located above the top face.

9 Claims, 3 Drawing Sheets

LIGHT EMITTING DIODE BULB

TECHNICAL FIELD

The present disclosure relates generally to illumination devices, and more particularly to a light emitting diode (LED) bulb, wherein the LED bulb has an improved light distribution by disposing LED modules on different faces of a polyhedron-shaped mounting base which have different orientations.

DESCRIPTION OF RELATED ART

LEDs are solid state light emitting devices formed of semiconductors, which are more stable and reliable than other conventional light sources such as incandescent bulbs. Thus, LEDs are being widely used in various fields such as numeral/character displaying elements, signal lights, light sources for lighting and display devices.

A traditional LED bulb includes a holder, a substrate located at one end of the holder and a plurality of LEDs mounted on a planar mounting face of the substrate. However, a light emitting angle of the traditional LED bulb is less than 120 degrees and a light intensity distribution of the traditional LED bulb is mostly concentrated at a center axis while becomes gradually weaker towards a periphery of the traditional LED bulb.

That is to say, when the plurality of LEDs are arranged on a same plane, it will result in an uneven light intensity distribution. Therefore, such an LED bulb is difficult to satisfy the requirements of uniform light distribution.

What is needed therefore is an LED bulb which can overcome the above mentioned limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Figure 1:
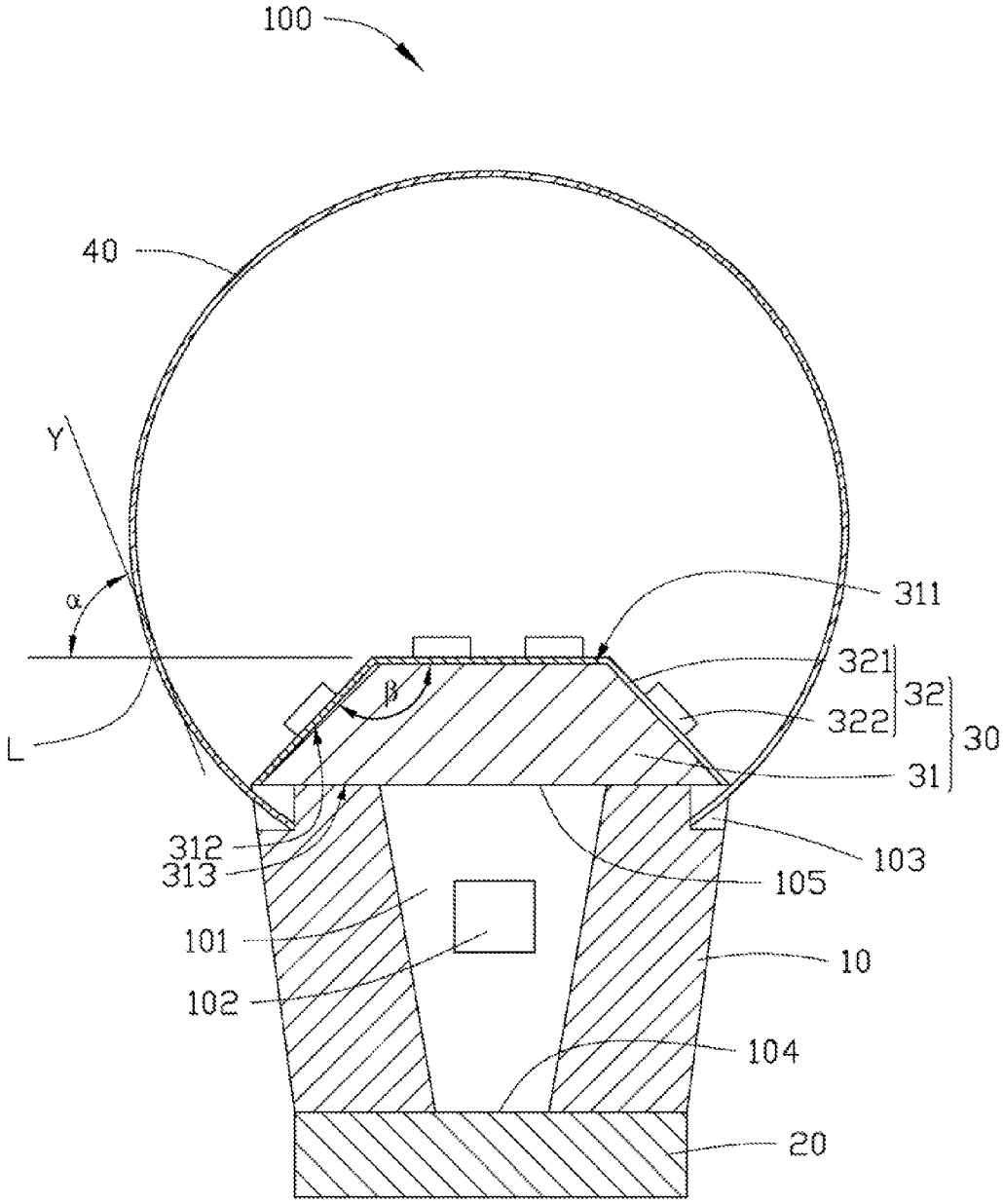
FIG. 1 is a cross sectional view of an LED (light emitting diode) bulb in accordance with a first exemplary embodiment of the present disclosure.

Referring to FIG. 1, a light emitting diode (LED) bulb 100 in accordance with a first exemplary embodiment of the present disclosure includes a connecting body 10, a lamp cap 20 located at a first end 104 of the connecting body 10, a mounting base 31 located at a second end 105 of the connecting body 10, at least two LED modules 32 mounted on the mounting base 31 and a lamp cover 40 connected to the connecting body 10 to cover the mounting base 31 and the LED modules 32.

The connecting body 10 is a hollow tube and provided with a passage 101 communicating with the two opposite ends, i.e., the first end 104 and the second end 105. The first end 104 of the connecting body 10 is an opened end which is sealed by the lamp cap 20. The second end 105 of the connecting body 10 is also an opened end which is sealed by the mounting base 31. In the present embodiment, the second end 105 of the connecting body 10 has a size larger than that of the first end 104 of the connecting body 10. The passage 101 has a diameter gradually increasing from the first end 104 to the second end 105.

The LED bulb 100 further includes a driving circuit module 102 received in the passage 110 of the connecting body 10. The driving circuit module 102 electrically connects the LED modules 32 and the lamp cap 20. The driving circuit module 102 is configured for supplying the electrical power to the LED modules 32.

A ring-shaped groove 103 is defined in the connecting body 10. The ring-shaped groove 103 is adjacent to a joint of the mounting base 10 and the second end 105 of the connecting body 10. The lamp cover 40 is fixed in the ring-shaped groove 103 of the connecting body 10.

The lamp cap 20 is electrically connected to an external power supply (not shown). In the present embodiment, the lamp cap 20 can be a B22 (bayonet 22 mm) male base. In another embodiment, the lamp cap 20 can be an E27 (Edison 27 mm) male screw base. As an alternative, screw threads could be formed on an outer circumference of the lamp cap 20 for securing the LED bulb 100 in a socket.

The mounting base 31 is made of a material with high heat dissipation efficiency (high heat conductivity), such as aluminum. The mounting base 31 is a polyhedron. The mounting base 31 has a top face 311 and at least three surrounding walls 312 connected to the top face 311. The top face 311 orients toward a direction different from that of each of the at least three surrounding walls 312.

In the present embodiment, the mounting base 31 is a frustum of a pyramid. The mounting base 31 includes four surrounding walls 312 connected end-to-end. The mounting base 31 includes a bottom face 313 spaced from and parallel to the top face 311 of the mounting base 31. The mounting base 31 is connected with the connecting body 10 via the bottom face 313 thereof. The bottom face 313 of the connecting body 10 has a same size as that of the second end 105 of the connecting body 10. An angle $\beta$ is formed between each surrounding wall 312 and the top face 311 of the mounting base 31. In the present embodiment, the angle $\beta$ is an obtuse angle between 100 degrees and 140 degrees. In this embodiment, the angles $\beta$ between the surrounding walls 312 and the top face 311 are identical to each other. Each of the surrounding walls 312 orients toward a direction different from that of each of the remaining surrounding walls 312.

An extension of the top face 311 of the mounting base 31 interests with the lamp cover 40 at a point L. A tangent line Y of the lamp cover 40 through the point L and the extension of the top face 311 form an included angle $\alpha$ which is less than 60 degrees. Furthermore, a center of the lamp cover 40 is located above the top face 311 of the mounting base 31.

The LED module 32 includes a substrate 321 and at least two LEDs 322 mounted on the substrate 321. In this embodiment, the LEDs 322 can be mounted on the substrate 321 via surface mounted technology. The mounting base 31 defines an inner passage (not shown) communicating with the passage 101 of the connecting body 10. Electrical wires (not shown) pass through the inner passage of the mounting base 31 and the passage 101 of the connecting body 10 to electrically connect the LED modules 32 and the driving circuit module 102.

The lamp cover 40 is made of transparent or translucent material such as glass, polycarbonate, for transmission of the light emitted from the LED module 32 therethrough. In the present embodiment, a lower portion of the lamp cover 40 is brought to clamp into the ring-groove 103 of the connecting body 10. The lamp cover 40 encloses the LED modules 32 therein. In another embodiment, the lamp cover 40 could be secured to the connecting body 10 via screwing means, ultrasonic welding or the like.

In the present embodiment, the LED modules 32 are mounted on the top face 311 and the surrounding walls 312 of the mounting base 31. The angle β between each surrounding wall 312 and the top face 311 is an obtuse angle in the range of 100-140 degrees. The LED module 32 on the top face 311 emits light in a direction different from the direction of the light beam emitted from the LED module 32 on each of the surrounding walls 312. The LED module 32 on each of the surrounding walls 312 emits light in a direction different from directions of the LED modules 32 on the remaining surrounding walls 312.

Therefore, the LED modules 32 emit light in all directions into the space around the LED bulb 100, including light toward the backside of the LED bulb 100 which is the light emitted from the LED modules 32 on the surrounding walls 312 and refracted backwardly by the lamp cover 40. Thus, the LED bulb 100 with omnidirectional light distribution similar to an incandescent bulb is obtained.

In addition, the geometric relationship that the angle α between tangent line Y of the lamp cover 40 through the point L and the extension of the top face 311 is less than 60 degrees and the center of the lamp cover 40 is located above the top face 311 of the mounting base 31, helps a portion of the light emitted from the LED module 32 mounted on the top face 311 of the mounting base 31 to be refracted by the lamp cover 40 toward the backside of the LED bulb 100.

Figure 2:
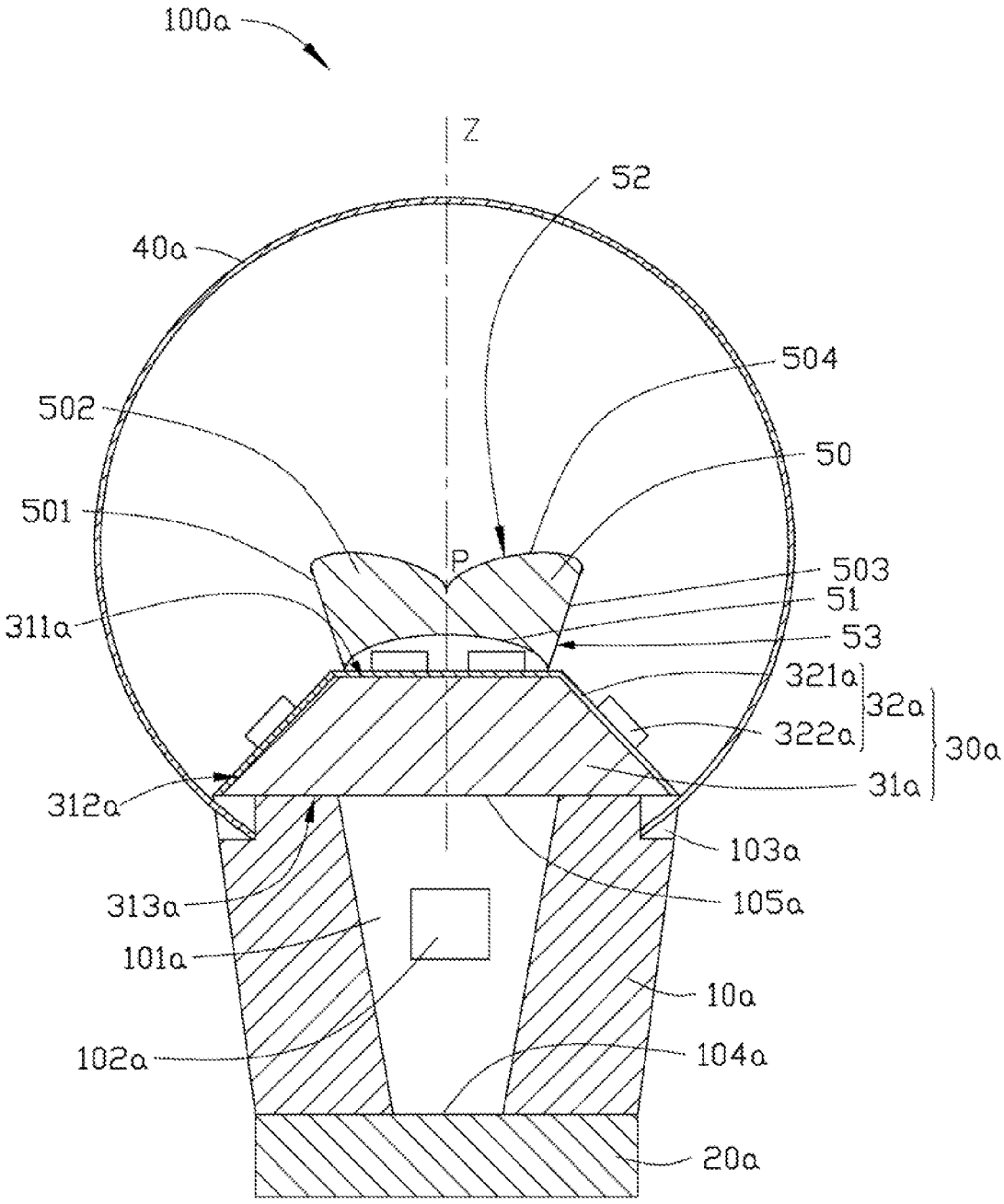
FIG. 2 is a cross sectional view of an LED (light emitting diode) bulb in accordance with a second exemplary embodiment of the present disclosure.

Referring to FIG. 2, a light emitting diode (LED) bulb 100*a* in accordance with a second exemplary embodiment of the present disclosure includes a connecting body 10*a*, a lamp cap 20*a* located at a first end 104*a* of the connecting body 10*a*, a mounting base 31*a* located at a second end 105*a* of the connecting body 10*a*, at least three LED modules 32*a* mounted on the mounting base 31*a*, a lamp cover 40*a* connected to the connecting body 10*a* and a lens 50 coupled to and covering the LED module 32 mounted on the top face 311 of the mounting base 31.

The lens 50 includes a concave light incident face 51, a convex light exiting face 52 opposite to the light incident face 51, and a connecting face 53 interconnecting the light incident face 51 and the light exiting face 52. The light exiting face 52 includes a first curved surface 502 and a second curved surface 504 connected with the first curved surface 502.

An inner periphery of the first curved surface 502 intersects with an inner periphery of the second curved surface 504 in a straight line p (the straight line p is illustrated in a dot shown in FIG. 2). The first curved surface 502 is symmetric with the second curved surface 504 with respect to a plane Z that contains the straight line p and is perpendicular to the top face 311*a* of the mounting base 31*a*. A distance between the light incident face 51 and the light exiting face 52 increases from the straight line p toward side faces 501, 503 of the lens 50 along a lateral direction. The light incident face 51 has a central axis of symmetry, and the central axis of the light incident face 51 lies in the plane Z.

Figure 3:
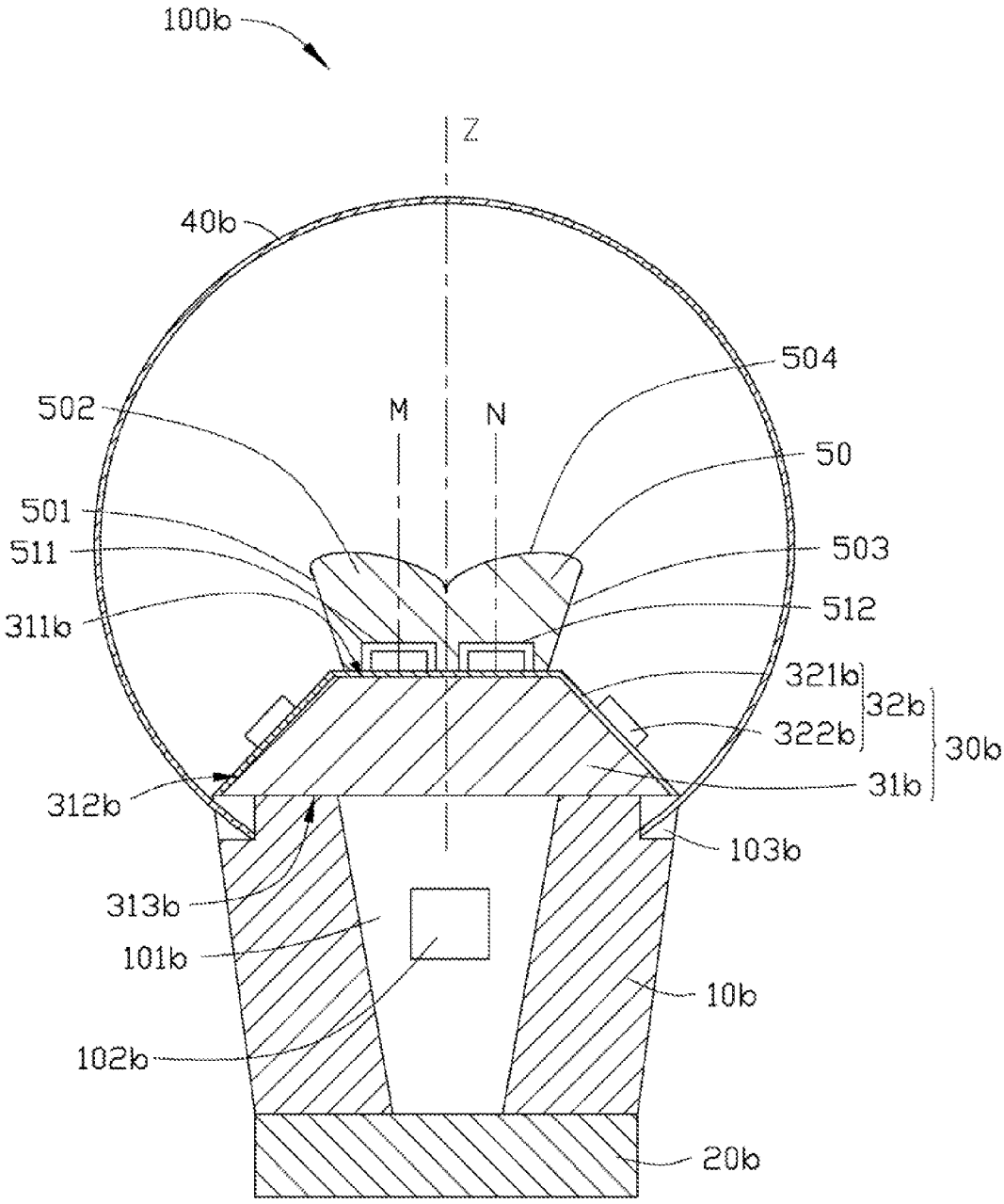
FIG. 3 is a cross sectional view of an LED (light emitting diode) bulb in accordance with a third exemplary embodiment of the present disclosure.

Referring to FIG. 3, different from the LED bulb 100*a* shown in FIG. 2, a light incident face 51 of the lens 50 of an LED bulb 100*b* in accordance with a third exemplary embodiment of the present disclosure includes a first light incident face 511 and a second light incident face 512 spaced from the first light incident face 511.

The first incident face 511 has a central axis M of symmetry, and the central axis M of the first incident face 511 deviates from the plane Z. The second face 512 has a central axis N of symmetry, and the central axis N of the second incident face 512 deviates from the plane Z. The central axis M of symmetry and the central axis N of symmetry are located on opposite sides of the plane Z, respectively.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A light emitting diode (LED) bulb comprising:

a connecting body;

a mounting base located at a second end of the connecting body opposite to a first end of the connecting body, the mounting base comprising a top face spaced from the connecting body and at least three surrounding walls interconnecting the connecting body and the top face thereof, the top face orienting toward a direction different that of each of the at least three surrounding walls;

a plurality of LED modules mounted on the top face and the at least three surrounding walls of the mounting base; and a lens coupled to and covering the LED modules mounted on the top face of the mounting base, the lens comprising a concave light incident face facing the LED modules mounted on the top face of the mounting base, a convex light exiting face opposite to the light incident face, and a connecting face interconnecting the light incident face and the light exiting face;

wherein the light exiting face comprises a first curved surface and a second curved surface, and an inner periphery of the first curved surface intersects with an inner periphery of the second curved surface in a straight line;

wherein the first curved surface and the second curved surface are symmetrically arranged with respect to a plane containing the straight line and perpendicular to the top face of the mounting base, and a distance between the light incident face and the light exiting face increases from the straight line toward the connecting face of the lens along a lateral direction;

wherein there are at least two LED modules mounted on the top face of the mounting base and receiving in a cavity surrounded by the light incident face, and the at least two LED modules are symmetrically arranged with respect to the plane containing the straight line and perpendicular to the top face of the mounting base; and wherein the light incident face is semi-spherical and has a central axis of symmetry, and the central axis of the light incident face lies in the plane containing the straight line and perpendicular to the top face of the mounting base.

2. The LED bulb of claim 1, wherein the mounting base further comprises a bottom face, and the mounting base is connected with the connecting body via the bottom face.

3. The LED bulb of claim 2, wherein the bottom face of the mounting base is parallel to the top face of the mounting base.

4. The LED bulb of claim 2, wherein the bottom face of the mounting base has a same size as that of the second end of the connecting body.

5. The LED bulb of claim 1, wherein the mounting base is a polyhedron.

6. The LED bulb of claim 5, wherein an angle between each surrounding wall and the top face of the mounting base is an obtuse angle.

7. The LED bulb of claim 1, further comprising a spherical lamp cover connected to the connecting body, wherein the lamp cover covers the mounting base and the LED modules mounted on the mounting base.

8. The LED bulb of claim 7, wherein an extension of the top face of the mounting base intersects with the lamp cover at a point, and an angle formed between a tangent line of the lamp cover through the point and the extension of the top face is less than 60 degrees.

9. The LED bulb of claim 8, wherein a center of the lamp cover is located above the top face of the mounting base.

* * * * *